United States Patent [19]

Weik et al.

[11] Patent Number: 4,642,891

[45] Date of Patent: Feb. 17, 1987

[54] METHOD OF MANUFACTURING CONTACT STRUCTURES

[75] Inventors: Guenter Weik, Engelsbrand; Max Ackermann, Wildbad, both of Fed. Rep. of Germany

[73] Assignee: Inovan-Stroebe GmbH & Co. K.G., Birkenfeld, Fed. Rep. of Germany

[21] Appl. No.: 722,702

[22] Filed: Apr. 12, 1985

[30] Foreign Application Priority Data

Apr. 18, 1984 [DE] Fed. Rep. of Germany ..... 3414656

[51] Int. Cl.[4] ..... H01R 43/02

[52] U.S. Cl. ..... 29/879; 29/882; 200/275

[58] Field of Search ..... 29/879, 882, 874, 876; 200/275

[56] References Cited

U.S. PATENT DOCUMENTS

| | | | |
|---|---|---|---|
| 1,837,238 | 12/1931 | Siegmund | 29/879 |
| 2,252,899 | 8/1941 | Reynolds | 29/882 X |
| 4,351,174 | 9/1982 | Bauer et al. | 29/874 X |
| 4,414,735 | 11/1983 | Buisson | 29/879 |

FOREIGN PATENT DOCUMENTS

| | | | |
|---|---|---|---|
| 857251 | 10/1952 | Fed. Rep. of Germany | 29/874 |

*Primary Examiner*—Howard N. Goldberg
*Assistant Examiner*—Carl J. Arbes

[57] ABSTRACT

A method of manufacturing contact structures on a support strap wherein at least one layer of a contact material such as gold, silver or alloys thereof is applied on top of the cross-web of a T-shaped metal strip of an easily cold stampable material and sections of predetermined length are cut from the T-shaped strip thereby providing contact members with stem portions with which they are inserted from one side of a support strap through corresponding openings stamped into the support strap whereupon the stems of the contact members which project through the support strap are stamped from the other side so as to firmly engage the contact members with the support strap. This method permits automatic manufacturing without damage to the contact surface of the contact members when being mounted on the strap.

11 Claims, 8 Drawing Figures

METHOD OF MANUFACTURING CONTACT STRUCTURES

BACKGROUND OF THE INVENTION

The invention relates to a method of manufacturing contact structures wherein one or more contact members having multiple layers of contact material are mounted on a carrier strap.

Contact members are needed in large amounts. Their manufacture therefore needs to be largely automated. Since, furthermore, the materials of which contact structures consist is generally quite valuable, the contact structures should be so composed that the valuable material is used only for the contact surface areas whereas the remainder of the contact structure consists of less valuable, that is, less expensive, materials. In order to make the contact structures relatively inexpensive, contact structures are, in many cases, bimetallic, especially those used in high power applications. Such bimetallic contact structures are usually supplied as contact rivets with rivet stems and rivet base plates consisting of copper and the contact area consisting of silver or a silver alloy. Such contact rivets are manufactured by welding a wire of copper or a copper alloy face-to-face together with a silver wire of corresponding diameter, cutting the wire and stamping the cut section into a rivet. Such contact members, although quite common in power supply systems, are not usable in connection with low voltage systems since the resistance at the bimetal interface of the silver or silver alloy contact areas is too high for low voltages or low currents. For such applications it is generally necessary to use noble metal contact areas, preferably gold contact structures or contact structures plated with gold. For economic reasons, however, the noble metal contact layers must have only limited thickness and can therefore not be manufactured in the same manner as the bimetallic contact structures previously described. For further savings in the use of noble metals, multiple contact metal layers preferably with a top layer of gold are sometimes utilized. But the manufacturing method described herebefore cannot be utilized for this kind of contact structure either.

It is also known in the art to make contact structures out of a contact strip having several layers of contact material disposed on a base strip of a relatively inexpensive material. Dice- or rod-shaped sections are cut from the strip and then stamped or shaped and press fitted or riveted into corresponding openings in a carrier strap. A disadvantage of this method, however, is that the contact material layers are heavily stressed by the subsequently necessary mechanical deformations whereby the desired layered structure will not normally be maintained. It has therefore also been tried to produce contact structures without first deforming the contact strip material. For that purpose, contact sections were cut from the contact strip and inserted in corresponding openings punched into a carrier strap into which they were stamped. However, this process also applies substantial mechanical stress to the contact layers.

Further, especially in order to save contact material, the contact material has been cut in such a manner as to produce wedge-shaped sections providing for members of generally eight edges. But naturally, also such a contact member is mechanically heavily stressed when being stamped into a carrier strap.

The heavy mechanical stresses referred to above are caused mainly by the fact that the thickness of the cut contact members is essentially constant over the whole contact member so that, consequently, a relatively large amount of material needs to be worked by application of correspondingly high pressures—in contrast to the contact rivets referred to above.

Taking into consideration the need for automated manufacturing, a method of producing contact members should therefore have the following particulars:

1. It should permit automatic mounting of the contact members onto a carrier strap.

2. Application of the contact members to the contact strip should generate the least possible amount of stresses, that is, the contact members should essentially not be deformed.

3. The contact members should have very thin noble metal contact surface layers of an even thickness of about 0.2$\mu$.

SUMMARY OF THE INVENTION

In a method of manufacturing contact members on a support strap which contact members have at least one layer of a noble contact material such as gold, silver or alloys thereof, a layer of the contact material is applied on top of the cross-web of a T-shaped metal strip of an easily cold stampable material such as copper wherein sections of predetermined length are cut from the contact strip so as to provide contact members with stem portions and the contact members are then inserted with their stem portions into corresponding openings formed in a support strap whereupon the stems of the contact members projecting through the support strap are stamped from the other side of the strap so as to firmly engage the contact members with the support strap without damage to the contact surfaces of the contact members.

In contrast to prior art methods, the method according to the present invention utilizes T-shaped strips so that for the mounting of the contact members cut therefrom only a relatively small amount of material, that is, the stem section which comprises about 1/5 to $\frac{1}{3}$ of the material, needs to be deformed. Furthermore, the specific pressure on the top surface of the contact members, that is, on the contact material, is substantially reduced (to about 1/10) such that the mechanical load on the contact material is negligibly small. The mechanical load is even further reduced by removal of a portion of the stem of the contact strip adjacent the cut edges of the contact member to a distance corresponding to the distance of the stem from the cross-web edges of the strip whereby the volume of the stem to be deformed during mounting on the carrier strap is further reduced.

Since, with the use of the method according to the invention, the contact material is subjected only to a very light mechanical load, the contact layer may be provided as desired for best contacting purposes substantially without consideration for mechanical strength to withstand deformation. As contact material, gold, gold alloys, silver, silver alloys and also silver metal oxides are considered to be very suitable. It is possible with the method according to the invention to utilize very thin layers in the $\mu$ range which was not possible with prior art methods because of the high load on the contact layers. It is furthermore possible to shield the contact layers from any kind of mechanical load if the contact material is applied only to the center area of the cross-web and the side surface areas adjacent the cross-web side edges are left uncovered so that a backup structure for holding the contact members during deformation of the stem engages the contact members in the contact-free areas along the web side edges—without even coming into contact with the contact material.

The same result can be obtained if the upper surface of the contact member has an upward projection and only the projecting portion is plated or, for example, galvanized. It is also possible to apply the contact material in such a manner along the center top line of the cross-web that it is curved upwardly in the form of a hump. Then, the side edge areas remain also uncovered for engagement by a backup structure during stamp-mounting of the contact member on the carrier strap.

The T-shaped contact strip preferably consists of easily deformable copper or a copper alloy with similar properties. The strip may be drawn, cast or cut to provide the T-shaped cross-section. However, it may also consist of two flat strips interconnected so as to provide the T shape and, furthermore, the two strips may consist of different materials. The stem section may consist, for example, of easily deformable copper whereas the cross-web section may consist of nickel or a nickel alloy in order to prevent transfer of corrosion products onto the contact material.

It is pointed out that manufacture of the contact strip, that is, the cutting of the strip to form the contact members and the mounting of the contact members on the carrier strap, can be performed easily in a fully automatic fashion.

Altogether, the method according to the invention provides the following advantages:

Automatic manufacturing is facilitated.

Manufacture of the contact structures is more economical than with prior art methods.

Execution of the manufacturing method is essentially independent of the thickness of the carrier strap.

The contact may easily be built up of several layers even several noble metal layers or metal oxide layers.

It may be built up of layers of different materials.

The thickness of the contact layers may be as small as practicable; it is not limited by mechanical strength requirements.

The contact area may be contained so as to provide optimal surface configuration without danger of damage thereto during assembly.

The noble metal contacts may be limited to a confined area as desirable.

With any desired configuration, no final forming or treatment of the contact surfaces is necessary.

It is apparent, consequently, that the method of making contact structures in accordance with the present invention does not only permit manufacture in an economical and efficient automatic fashion but it provides also for optimally structured contacts.

SHORT DESCRIPTION OF THE DRAWINGS

The figures show different contact structures made in accordance with the method of the invention. Specifically, FIGS. 1 to 4 are perspective views of T-shaped contact strips each with a different contact layer disposed thereon;

DESCRIPTION OF PREFERRED EMBODIMENTS

Figure 1:
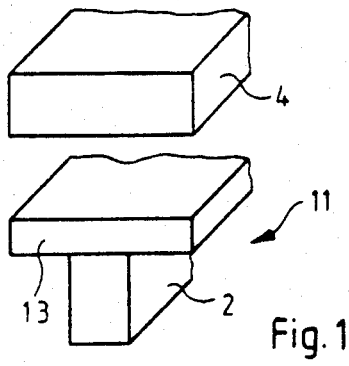
Figure 2:
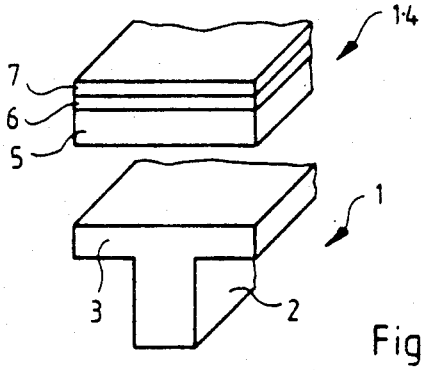
Figure 3:
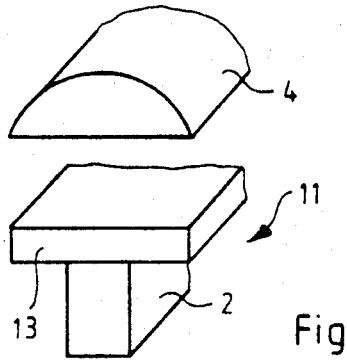
Figure 4:
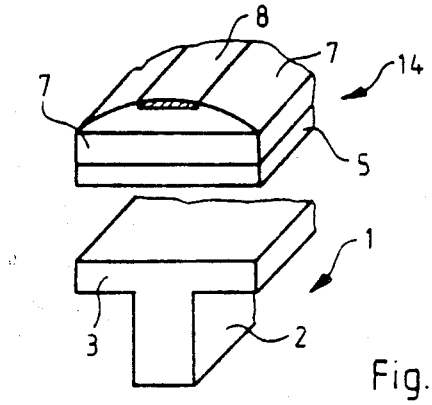

A T-shaped contact support strip 1, 11 consists of a stem 2 with cross-web 3, 13 which may be made as a unitary structure of copper or a copper alloy as shown in FIG. 2 or as shown in FIG. 1, the support strip 11 may have a stem 2 of copper with a cross-web 13 of a different material such as nickel or a nickel alloy. Disposed on the T-shaped support strip 1, 11 is a contact material layer 4, 14 which is firmly attached by any kind of mounting method, for example, by hot roll plating, roll welding, brazing, laser welding or electron beam welding. The contact material layer 4 as shown in FIG. 1 consists of a single material whereas the contact material 14 as shown in FIGS. 2, 4 consists of multiple material layers. As shown in FIG. 2 there may be provided, for example, a nickel layer 5 with two noble metal layers on top thereof or, as shown in FIG. 4, there may be another noble metal layer 8 received in the upper noble metal layer 7.

Figure 5:
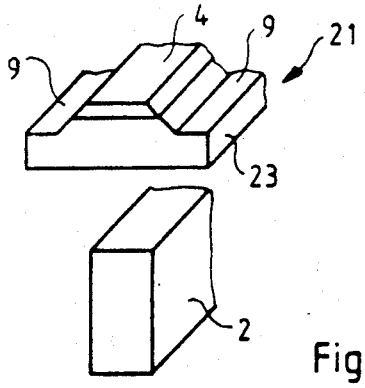
FIG. 5 shows a T-shaped contact strip composed of two flat strips, one forming a cross-web with a contact layer thereon.

In the arrangements of FIGS. 1 to 4, the contact metal layers 4, 14 extend over the whole width of the cross-web 3, 13. In contrast, in the arrangement according to FIG. 5, the T-shaped strip 21 is composed of a stem 2, for example, of copper and a cross-web 23, for example, of nickel or a nickel alloy and the cross-web 23 is profiled such that it has shoulder portions 9 which are free of any contact material and provide mounting surfaces adapted to be engaged when inserted as a contact structure 21 into a carrier strap 10.

Figure 6:
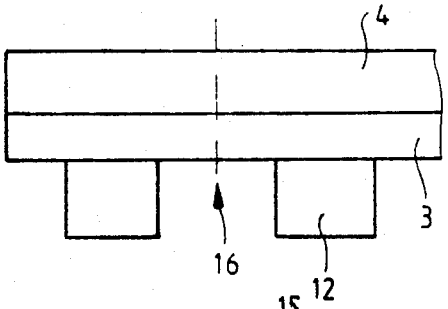
FIG. 6 is a side view of a contact strip.

FIG. 6 is a side view of a contact strip from which the contact structures are cut in a length as desired. In the embodiment as shown, the stem sections are spaced such that the cutting plane 16 is spaced from the stem 2 a distance corresponding to the distance of the stem 2 from the side edges of the cross-web 3, 13, 23. In this manner, rivet-type contact structures are formed which are not only easy and simple to mount to the carrier strap 10 but which, furthermore, result in other minimal strength reduction of the carrier strap.

Figure 7:
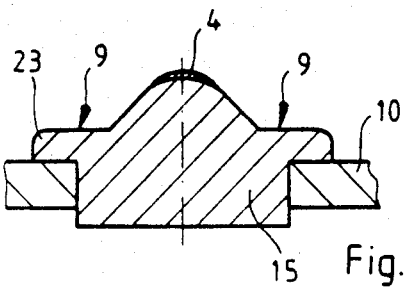
FIGS. 7 and 8 show a carrier strap with contact members mounted thereon.
Figure 8:
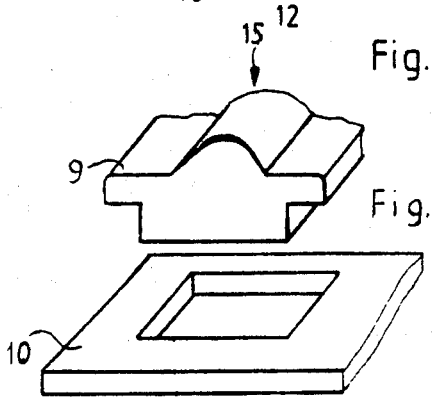

FIGS. 7 and 8 show a contact member 15 inserted into a carrier strap 10 which also has shoulder portions 9 at opposite sides for engagement by a retainer and, furthermore, a cross-web 23 which is profiled at its top with its curved top having an arched noble metal layer 4 disposed thereon.

We claim:

1. A method of manufacturing contact structures for low energy switching applications wherein a number of contact members consisting of layered contact materials are mounted on a support strap, said method comprising the steps of:

providing a T-shaped metal strip of an easily cold stampable material, said metal strip having a stem and a cross-web and said cross-web having a center portion and shoulder portions alongside said center portion;

firmly applying to the center portion of said cross-web at least one layer of a contact material thereby providing a contact strip;

providing in said support strap openings of a width corresponding to the width of said stem and of a length corresponding to a predetermined length of the stem of said contact members;

cutting from said contact strip sections with stem portions of said predetermined length thereby providing contact members and placing said contact members on said support strap from one side thereof such that the stems of said contact members extend through the openings in said support strap;

holding said contact members in position on said shoulder portions; and stamping said stems from the other side of said support strap so as to firmly engage said contact members with said support strap.

2. A method according to claim 1, wherein said T-shaped metal strip consists of copper or a copper alloy.

3. A method according to claim 1, wherein said T-shaped metal strip is made by interconnecting two flat strips in T form.

4. A method according to claim 3, wherein two strips of different materials are interconnected to form said T-shaped contact strip.

5. A method according to claim 4, wherein said cross-web consists of a nickel-based material.

6. A method according to claim 1, wherein the cross-web of said contact strip is provided with a top profile.

7. A method according to claim 1, wherein said contact material is applied to the center surface area of said cross-web leaving the edges of said cross-web uncovered.

8. A method according to claim 1, wherein the contact material is so applied to said cross-web as to form a raised area along the center line of said cross-web.

9. A method according to claim 1, wherein the ends of said stem are cut back from the ends of said cross-web a distance corresponding to the distance of the stem from the side edges of said cross-web.

10. A method according to claim 1, wherein said layer of contact material consists of a noble metal comprising gold, silver and alloys thereof and said layer is applied with a thickness of $0.2\mu$ to $500\mu$.

11. A method according to claim 1, wherein said contact layer consists of silver metal oxide.

* * * * *